United States Patent [19]

Houseman et al.

[11] 4,312,595

[45] Jan. 26, 1982

[54] AUTOMATIC FLUID MIXING SYSTEM AND A MULTI COMPARTMENTED CONTAINER THEREFORE

[75] Inventors: Kenneth O. Houseman, St. Charles; Wolfgang O. Junkel, Mt. Prospect, both of Ill.

[73] Assignee: Litton Industrial Products, Inc., Beverly Hills, Calif.

[21] Appl. No.: 903,083

[22] Filed: May 5, 1978

[51] Int. Cl.[3] ..... B01F 15/04

[52] U.S. Cl. ..... 366/153; 222/87; 137/101.27; 137/101.25; 366/167; 366/177; 354/323

[58] Field of Search ..... 366/151, 152, 153, 162, 366/167, 173, 182, 177; 222/83, 87, 132, 144; 137/101.27, 101.25; 354/323, 328

[56] References Cited

U.S. PATENT DOCUMENTS 3,765,576 10/1973 Ramsdale ..... 222/132

3,933,268 1/1976 Buske ..... 220/23.4

4,098,431 7/1978 Palmer et al. ..... 222/39

4,103,358 7/1978 Gacki et al. ..... 366/153

*Primary Examiner*—Harvey C. Hornsby

*Attorney, Agent, or Firm*—Robert A. Seldon

[57] ABSTRACT

An automatic fluid mixing system is disclosed which, in its preferred embodiment, discontinuously opens a disposable multi-compartmented module to permit the mixing of initially released contents before the subsequent opening of remaining compartments, flushes each compartment with base liquid, and utilizes knife-edge pairs to slit the module in a manner which permits rapid release of the contents.

The preferred system additionally includes means responsive to specific gravity of the solution for controlling the amount of base liquid introduced into the solution and a level sensing mechanism including a magnetic float assembly employing magnetically responsive switches to electronically sense liquid level.

31 Claims, 13 Drawing Figures

FIG. 2
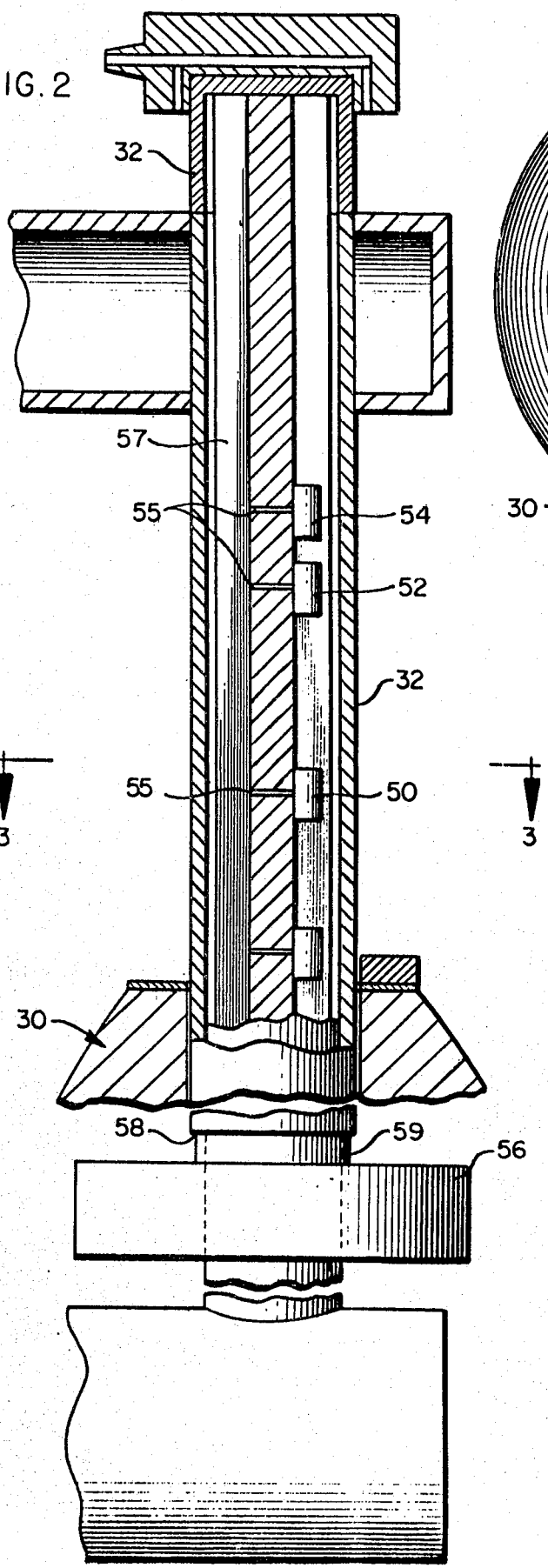
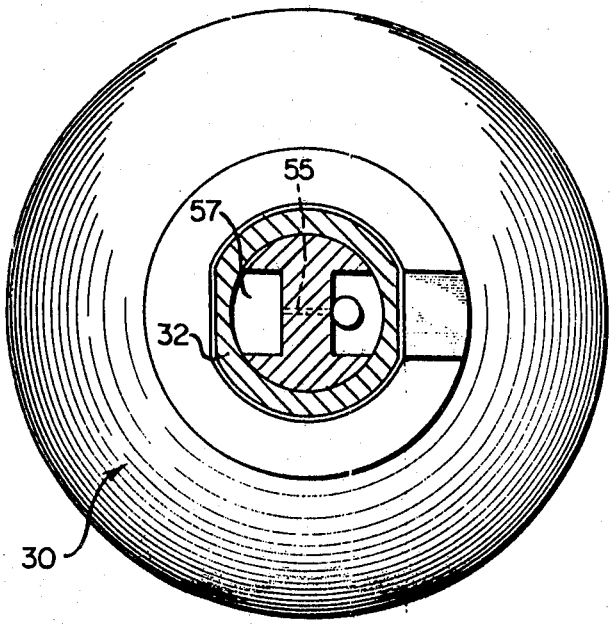
FIG. 3

AUTOMATIC FLUID MIXING SYSTEM AND A MULTI COMPARTMENTED CONTAINER THEREFORE

BACKGROUND OF THE INVENTION

1. Field of the Invention

The present invention relates generally to automatic fluid mixing systems and has particular applicability in the field of automatic film processing wherein the fixer and developer solutions are conventionally prepared just prior to use to avoid decomposition. The presently described system will accordingly be discussed in this context, although it is to be understood that its use is not so limited.

As is generally known in the field of film developing, the eveloper solution is prepared from constituents known in the art simply as "A", "B", and "C" solutions. The Fixer solution, on the other hand, typically comprises two constituent components typically referred to as the A and B Solutions. It should be noted, for the sake of clarity, that the A Solutions and the B Solutions for the developer and fixer are chemically different, although similarly designated.

As indicated above, the constituent components of the developer and fixer are typically mixed with water, in predetermined ratios, just prior to use of the respective solution. The A, B, and C Solutions are generally purchased as concentrates for the sake of economy and mixed with water, in accordance with known "recipes", on site.

DESCRIPTION OF THE PRIOR ART

The mixing of the chemical constituents for each of the developer and fixer solutions has heretofor been performed manually. It may be appreciated that the manual procedure is cumbersome and time consuming. Users of the film-developing systems must divert their attention from the developing process to the mixing of the chemicals at appropriate times. In addition to such inherent problems as spillage and measurement errors, one particular problem has been the inadvertent dividing of, and microcrystalization in, the developer solution caused by rapid changes in solution pH as ingredients are added.

U.S. Pat. No. 3,765,576 to Ramsdale discloses a liquid dispensing device in which a circularly disposed plurality of containers, having respective outlets positioned over a bowl, are filled with specific quantities of respective chemicals. The chemicals may be released in a given sequence by the sequential activation of solenoid valves in the respective outlets.

SUMMARY OF THE INVENTION

The chemical mixing system described herein basically comprises a housing which includes means defining a reservoir and means for supporting a plurality of containers, inlet and outlet conduits communicating with the reservoir for respectively permitting the ingress and egress of liquid, liquid level sensing means for producing an enabling signal when the liquid level of the reservoir falls below a preselected level, means responsive to the enabling signal for permitting a quantity of base liquid (such as water) to flow into the reservoir through the inlet conduit, flow into the reservoir through the inlet conduit, and means responsive to the enabling signal for discontinuously opening the containers whereby the contents are mixed in a pre-selected sequence.

An additional feature of the invention relates to the level sensing means which preferably employs a magnetic float mechanism mounted for movement on a tubular shaft which contains a vertically disposed plurality of magnetically responsive switches. The state change of the switches provides an electronic indication of liquid level, although the switches are, themselves, isolated from the corresive effects of and short-circuiting by, the solution.

Another feature of the invention relates to a mechanism which flushes the module compartments as they are drained so that the module may be safely disposed.

Another aspect of the present invention relates to the multi-compartmented container. A self-contained multi-compartmented module, comprises a plurality of mating containers having respective inter-engaging exterior faces which are uniquely complimentary so as to restrict the interchangability of the containers within the module thus formed, and means for securing the containers in the modular relationship to permit movement of themodule as a unit. As will be appreciated from the following description, the containers thereby form a portable self-contained multi-compartmented module without the need for cartons or other carriers. As will be additionally shown in greater detail, the modules are particularly useful in the presently disclosed system, where the restriction in container interchangability insures that the chemicals contained therein will be mixed in a predetermined sequence.

The foregoing features are described in greater detail in the following description of the preferred embodiment which includes the following figures.

DESCRIPTION OF THE DRAWINGS

FIG. 2 is a fragmentary sectional view of the liquid level sensing means in accordance with the invention, and take along line 2—2 in FIG. 1, FIG. 3 is a sectional plain view of the level sensing means taken along line 3—3 in FIG. 2.

DESCRIPTION OF PREFERRED EMBODIMENT

The automatic mixing system described herein may be conveniently used in the field of automatic film processing where it is desirable to mix the Fixer and Developer solutions just prior to use to avoid decomposition. Accordingly, the system will be described in light of this application, although it is understood that its use is not so limited.

Figure 1:
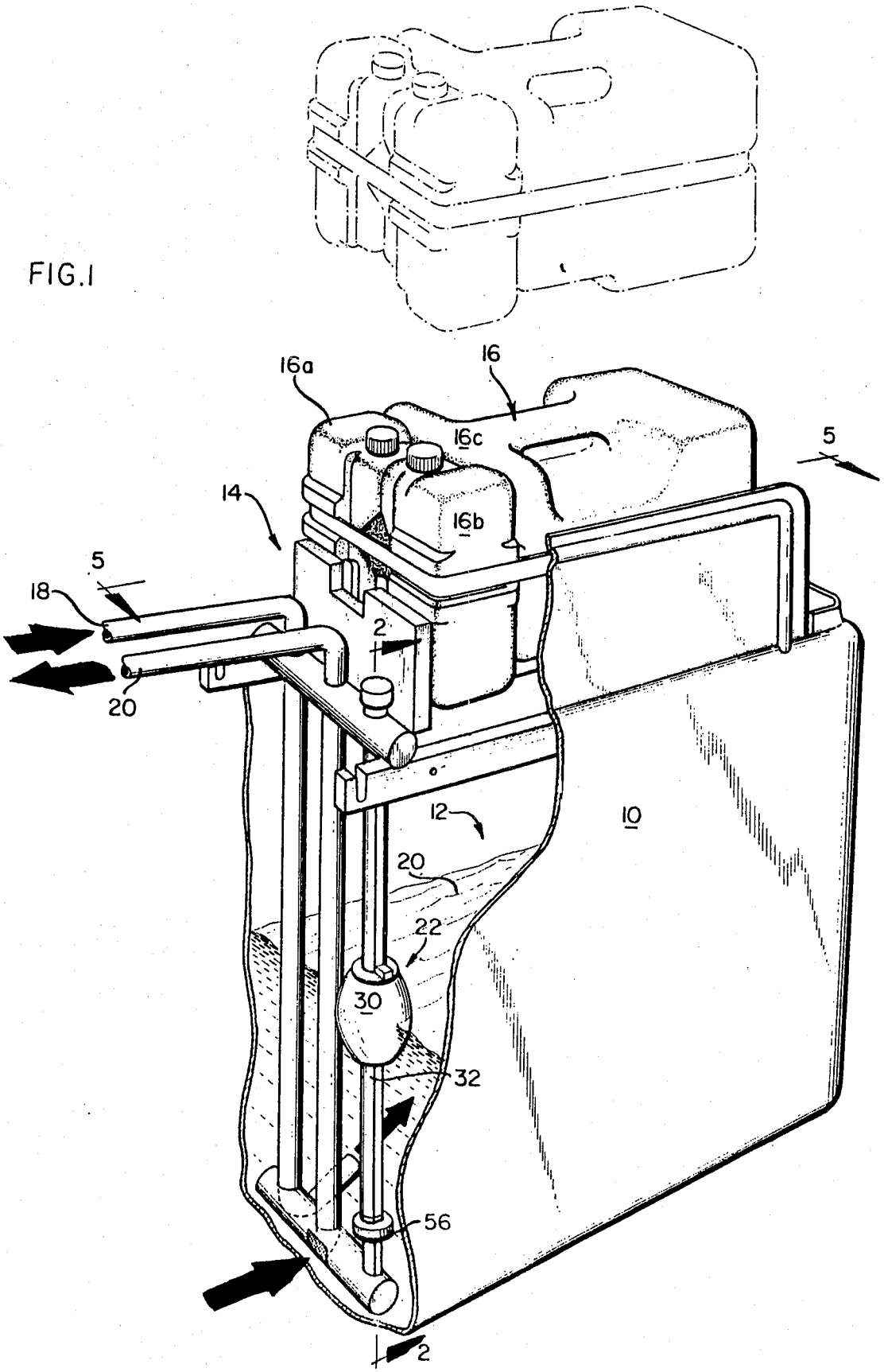
FIG. 1 is a fragmentary isometric view of an automatic mixing system constructed in accordance with the present invention.

FIG. 1 is an isometric view of an automated mixing system constructed in accordance with the invention. The system is seen to comprise a housing 10 which defines a reservoir 12 and, as subsequently described, means 14 for supporting a plurality of containers of chemicals such as those defined by a multi-compartmented module. Inlet and outlet conduits 18, 19 respectively communicate with the reservoir via solenoid valves and respectively permit the ingress of a base liquid such as water, in the case of Developer solutions, and egress of the solution.

Where the module 16 is to hold the chemical concentrates for a developer solution, the compartments 16*c, a, b* may conveniently be sized to respectively hold A, B and C solution concentrates in proper ratios. In practice, volumes of 5.0 gallons (18.927 1) of A Solution, 0.5 gallons (1.892 1) of B Solution and 0.5 gallons (1.892 1) of C Solution, have been found to provide a total weight which may be manually lifted and manipulated without strain.

Liquid level-sensing means 22, produces control signals which indicate the passing of the liquid level through certain critical levels. As shown in FIGS. 1–3, the level-sensing means preferably includes a tubular shaft 32 containing a plurality of magnetically responsive reed switches 50, 52, 54. A float 30 includes a collar containing sintered ceramic magnets which activate the switches 50, 52, 54 as the float moves vertically along the shaft with changing liquid level. As will become apparent in the following description, the state changes of the switches electronically activate various components of the system to automatically and correctly mix the various chemical concentrates with the base liquid to form the solution 20 (FIG. 1). Electrical connections to the switches are made via leads which pass through channels 55 to passageway 57 and emerge at the top of the shaft 32 for connection to appropriate circuitry.

Also shown in FIG. 2, and more fully explained herein below, is a second float 56 which is mounted for constrained vertical movement on the shaft 32 in communication with the solution 20. The float 56 has a specific gravity which is selected in accordance with the desired specific gravity for the solution 20 and is used in the automatic control of the mixing process as hereinafter described.

Figure 4:
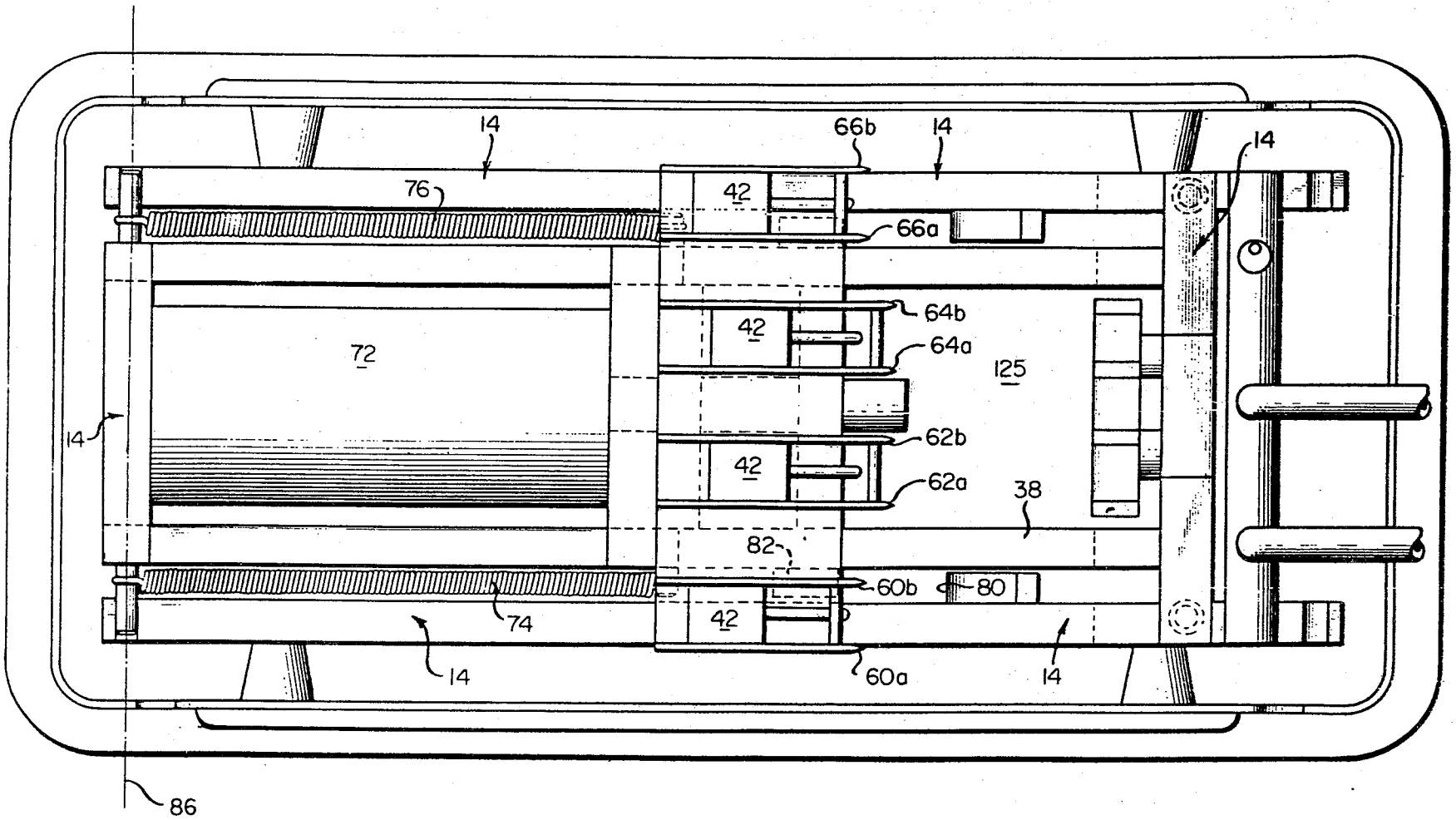
FIG. 4 is a plan view of the compartment-supporting and operning features of the system.
Figure 5:
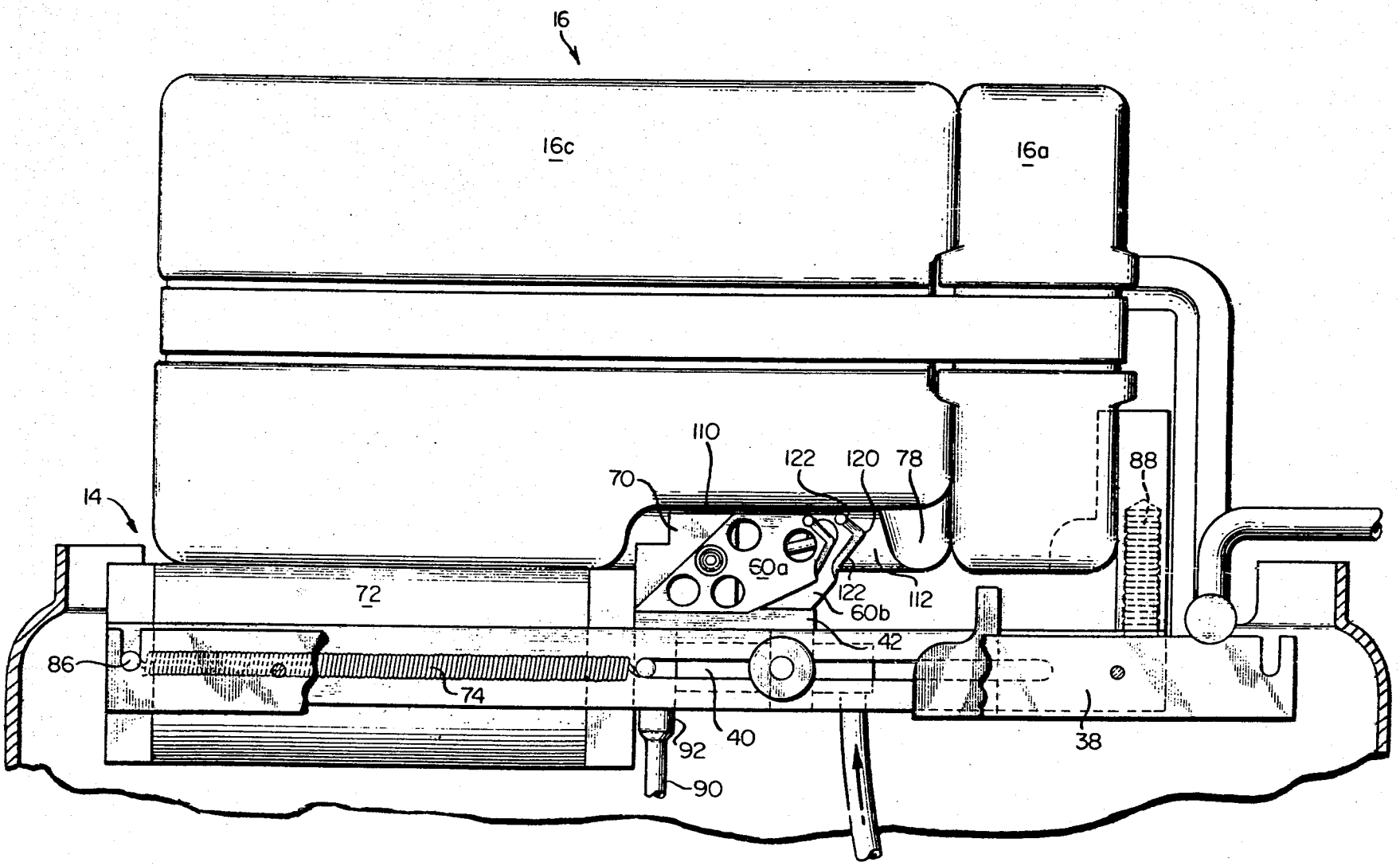
FIG. 5 is a partially sectioned side elevation view of the compartment-supporting and opening features of FIG. 4 illustrated with a supported multi-compartmented module.

As shown in FIGS. 4 and 5, the module-supporting means 14 is a generally frame-like member enclosing a space 125 which overlies the reservoir 12. The support member 14 is mounted in the housing for acute rotation about axis 86. The placement of a full module on the support member 14 accordingly causes an acute clockwise rotation of the member 14 about the axis 86. A magnetic member, movable with the rotating member 14 may conveniently actuate a magnetically responsive switch similar to those shown in FIG. 2, or other means may be used to indicate the presence of a loaded module. A compressed spring 88 exerts a counterclockwise torque on the member 14 which is less than the clockwise torque exerted by the module weight when the compartment 16*c* is empty.

Figure 6A:
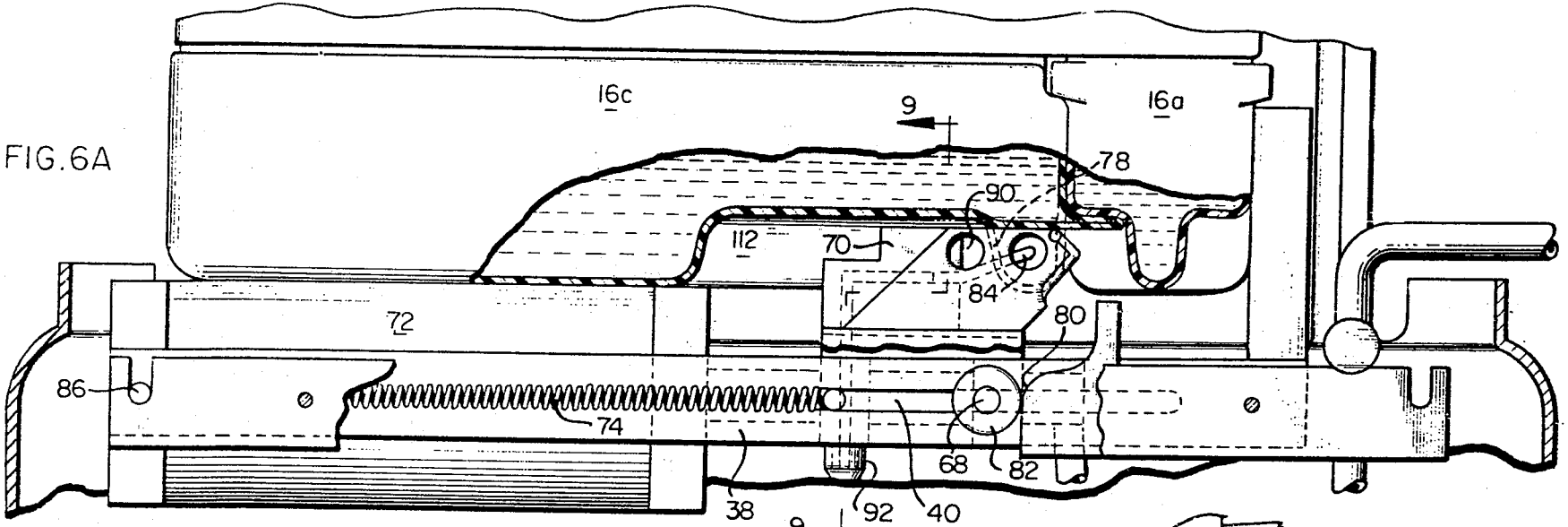
FIGS. 6*a* and 6*b* are enlarged partially sectioned side elevation views showing the compartment-opening sequence, FIGS. *7a* and *7b* are enlarged top plan and front elevation views, respectively, of an alternative embodiment of the compartment-opening mechanism.
Figure 6B:
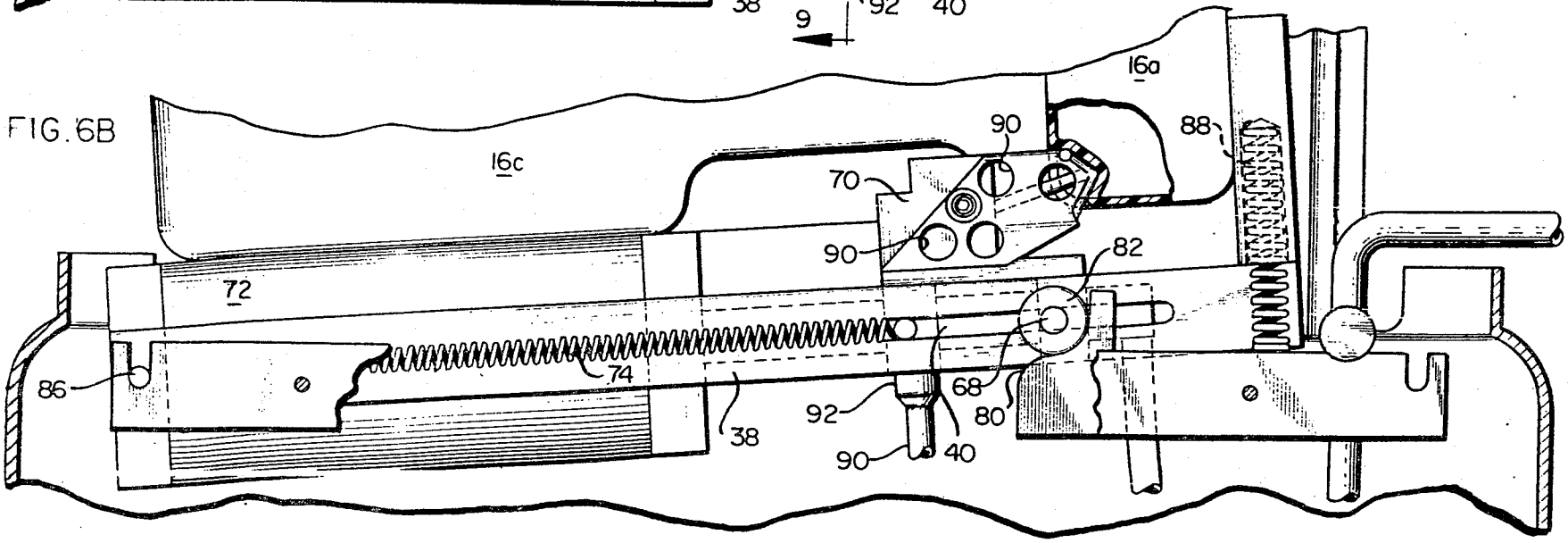

The module-supporting member 14 includes a pair of slotted side rails 38, 39. The slot 40 of rail 38 is shown in FIGS. 5 and 6*a* and 6*b*. Interjacent the rails 38, 39 is a sliding member 42, having a plurality of laterally spaced blade pairs 60*a–b*, 62*a–b*, 64*a–b*, and 66*a–b*. As shown in FIG. 5, the edges within each blade pairs are preferrably staggered with blade 60*b*, for example, leading blade 60*a*. The sliding member 42 moves the blades from a sheated position shown in FIGS. 4 and 5, to first and second module-piercing positions shown in FIGS. 6*a* and 6*b*, respectively, and is guided for such forward movement by a cross member 68 which extends through the slots of the side rails 38, 39.

The forward movement is caused by the piston of a hydraulic cylinder 72 to which the sliding member 42 is coupled. The cylinder 72 is activated by means responsive to the previously described level sensing switches. Deactivation of the piston 72 permits the return of the blades to the sheathed position by return springs 74, 76, coupled between the side rails 38, 39 and sliding member 42.

Figure 9:
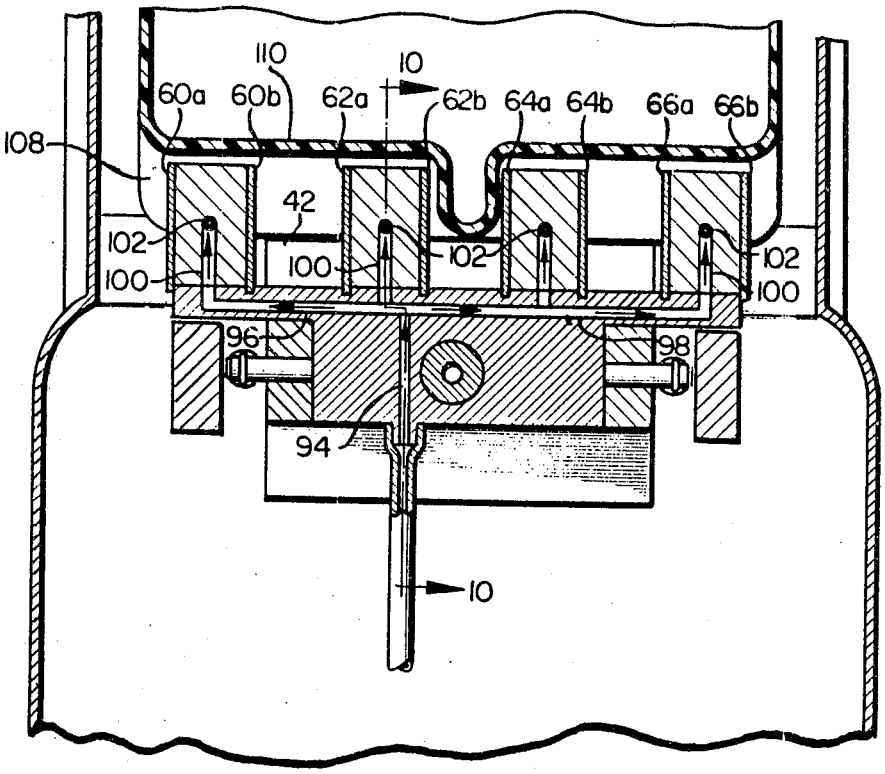
FIG. 9 is a sectioned front elevation view of the module-opening mechanism taken along line 7—7 in FIG. 6 to show the compartment-flushing feature of the system.
Figure 10:
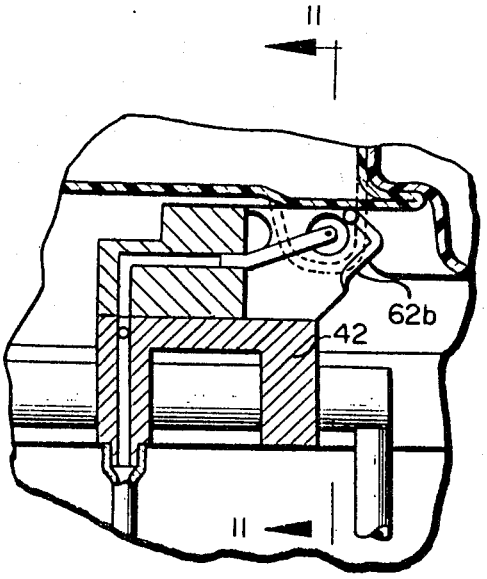
FIG. 10 is an enlarged sectional view taken along line 10—10 in FIG. 9 showing further details of the module-flushing feature.
Figure 11:
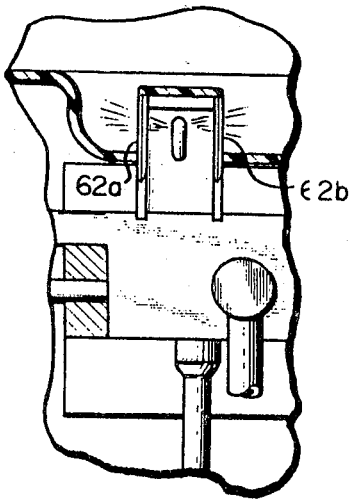
FIG. 11 is an enlarged section view taken along line 11—11 of FIG. 10.

As shown in FIG. 5, the bottom 108 of the module 16 is recessed at 110 to overly the sheath 70, and protrudes downward in a lip-shaped manner at 78. The protrusion 78 is positioned for piercing contact by the knife edges. FIG. 9, a sectional view taken along line 9—9 in FIG. 6*a*, shows the recessed portion 110 of the module 16 as well as a channel-shaped segment 112 between the first and second bottom portions 108, 110 lying within, and extending along the region between the blades.

Returning to FIGS. 5 and 6*a* and 6*b*, the knife edges initially contact the downward-extending lip 78 of the module 16 at a leading point 120 of the blade. A concentration of forces at the relatively small point of contact enables the blade to initially pierce the lip 78 and the continuing forward motion of the blades thereafter produces a slicing action of the lip 78 by the generally rearward-extending blade edges 122. The forward movement of the blades is interrupted by the contacting of a cam surface 80 by a member 82 which is coupled to the laterally extending crossmember attached to the sliding member 42.

When the member 82 has been engaged by the cam surface 80, the inner pair of blade pairs 62,64 have formed a series of laterally spaced pairs of slits. Mounted between the blades of each pair is a deflection member which engages the portion of the lip 78 located between the respective pair of slits and deflects the lip portion forwardly to expeditiously release the contents of the compartment 16*c* into the reservoir of the mixing system via space 125 (FIG. 4). The channel 112 allows complete drainage of the compartment 16*c* by permitting the last of the liquid to bypass, and overcome, the elevation of the compartment bottom created by the exterior recess 110.

As explained earlier in the specification, it is desirable to mix the contents of compartment 16*c* prior to the contents of container 16*a* in order to prevent such adverse reactions as microcrystallization and clouding of developer solutions. When the compartment 16*c* has emptied, the reduced weight of the module 16 permits the spring 88 to rotate the support frame 14 counterclockwise about axis 86, consequently disengaging the member 82 from the cam surface 80 and permitting further forward movement of the blades. As shown in FIG. 4*b*, the blades then pierce and slit the compartments 16*a*, 16*b* in a similar manner, with drainage and flushing action taking place as described.

As the contents of the compartment 16*c* are realeased, a flushing action is provided via nozzles 84*a–b* respectively located between each of the knife pairs. The compartments are flushed with a fluid such as water to reduce any toxic residues within the container, permitting safe disposal of the empty module in conformance with environmental standards. As shown in FIGS. 6*a*, 6*b*, 9, 10, and 11, fluid is introduced into the flushing mechanism from a source via conduit 91 which is coupled to a fitting 92 affixed to the sliding member 42. The fluid is guided via channel 94, formed in the sliding member 42, which branches into two paths 96, 98 which in turn, respectively, branch into channels 100 associated with each blade pair. The channels 100 respectively terminate in rearward facing nozzles 102 which are positioned between the respective knife pairs to shoot flushing fluid through openings 90 formed in the blades into the compartment.

Figure 7A:
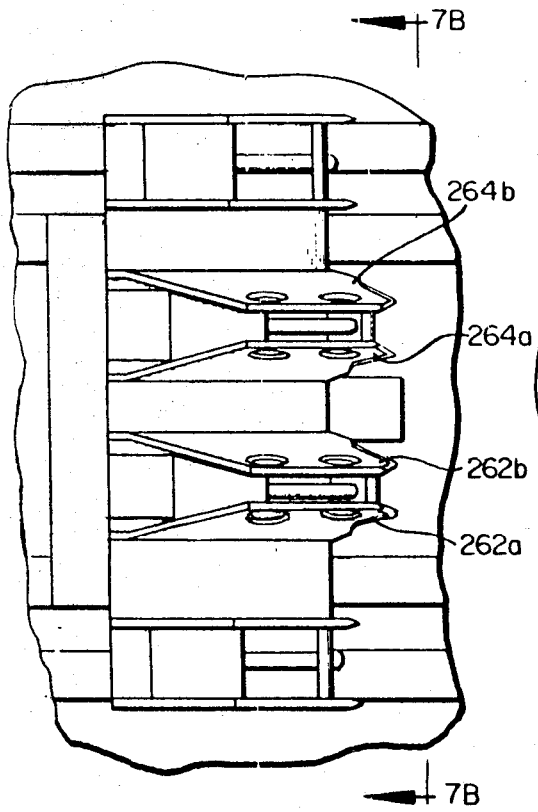
Figure 7B:
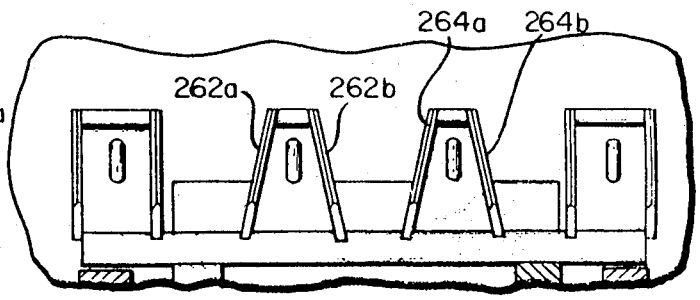
Figure 8:
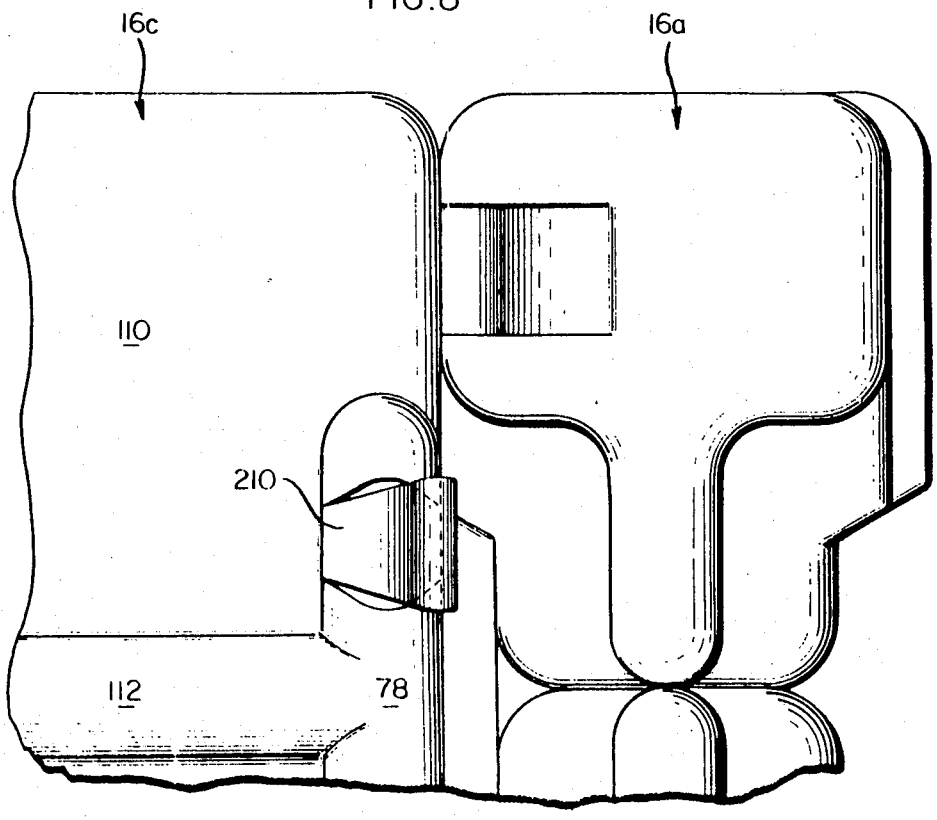
FIG. 8 is an enlarged bottom plan view of the module showing the results of the compartment-opening mechanism of FIGS. *7a* and *7b*.

It is highly desirable to insure that the compartment openings, created by the blades, remain open subsequent to the slitting and deflecting of the compartment material. Accordingly, as illustrated in FIGS. 7*a*, 7*b*, and 8, the inner blade pairs 262*a–b*, 264*a–b*, may be obliquely oriented in a manner which produces a pair of generally wedge shaped paths, such as tab 210, in the lip 78. It may be appreciated that as the blades move across the lip 78, the tab 210 will be forwardly and upwardly deflected so that a portion having Width will become wedged within the upper and narrower cutout region lying on the aft side of the lip 78.

In operation, the mixing system functions as follows: the module 16 is first loaded onto the support means 14, causing the support member 14 to rotate clockwise about the pivot axis 86. The presence of a loaded module on the support means may be sensed electronically by such means as a contact switch actuated by the rotation of the side rails 38, 39 or, alternatively, via a magnet moveable in response to the rotation to actuate one of the magnetically-responsive switches associated with the interior of the tubular shaft 32.

It may be appreciated that the reduction in the level of solution 20 will result in a state change of the magnetically responsive switch 50 as the float 30 passes downwardly through the pre-selected level. If a loaded module 16 is detected, as provided above, the downward passing of the switch 50 by the float 30 starts the recharging cycle of the mixing system. Otherwise, a warning system may conveniently be activated.

Initially, the base liquid, such as water in the case of developer solution, is permitted to enter the reservoir 12 via the inlet line 18 by means such as a solenoid actuated valve. As the rising level in the reservoir pushes the float 30 upward to the position of the magnetically responsive switch 52, the state change of that switch fires the module-opening mechanism described hereinabove. The module compartments 16*a*, *b*, *c* are discontinuously and sequentially opened and flushed. Completion of the emptying of the chemicals may be detected via an additional magnetically-responsive switch mounted slightly above the switch 52 at a position corresponding to the level to which the float 30 will rise owing to the volume of the chemical concentrates added to the reservoir 20.

During the opening of the module 16, water continues to flow into the reservoir via the inlet conduit 18, until the solution reaches the proper ratio of concentration/water. Several methods for determining the shut-off time for the water are possible. The method most commonly employed is the volumetric method whereby the rising of the reservoir contents to a particular level would deactivate the solenoid valve in the inlet line via the level sensing mechanism. However, the critical parameter, only indirectly controlled by the volumetric method, is specific gravity: the resulting developer solution must typically have a specific gravity of $1.09 \pm 0.005$ to be effective. To overcome inaccuracies associated with volumetric mixing, the disclosed invention includes means for mixing the solution 20 in accordance with the specific gravity of the solution.

Returning to FIG. 2, wherein the float 56 is shown mounted for constrained vertical movement on the shaft 32, it has been found that providing the float 56 with a specific gravity of 1.090 provides a sensitive means for electronically detecting the density of the solution. When the reservoir is initially empty and water is added the float 56 will sink since the specific gravity of the solution will be approximately 1.0 and, therefore, less dense than the float 56. When the compartments of the module 16 are opened, the float 56 will rapidly rise until its collar 59 contacts a shoulder 58 of the shaft owing to the momentarily high specific gravity of the solution 20. As the reservoir 12 continues to fill with water, however, the float 56 will rapidly sink when the decreasing specific gravity of the solution is approximately 1.090. The float 56 is preferably a non-corroding material having a ferreous material within, thereby inducing a state change in a magnetically responsive switch, de-activating the solenoid valve, and shutting off the water, when the float sinks subsequent to activation of the blades. If float 56 fails to drop for some reason, an additional magnetically responsive switch may be located in the upper portion of the shaft 32 to shut the valve off when the solution reaches a level which the approximate specific gravity is 1.095.

Circuitry necessary for performing the foregoing functions in response to properly sequenced state changes of the switches is known to those skilled in the art and, for brevity, not discussed. While the foregoing detailed description is concerned with a preferred embodiment of the invention, many variations and modifications would be obvious to those skilled in the art. Accordingly, it is intended that the invention not be limited to the described embodiment, but be construed only as limited by the following claims:

We claim:

1. An automatic fluid mixing system comprising:

a housing including means defining a reservoir and means for supporting a multi-compartmented container in a position which is displaced from an initial position in general proportion to the weight of the container;

inlet and outlet conduit means communicating with the reservoir for respectively permitting the ingress and egress of liquid;

liquid level sensing means for producing an enabling signal when the liquid level in the reservoir falls below a preselected level;

means responsive to the enabling signal for permitting a quantity of base liquid to flow into the reservoir through the inlet conduit means; and means responsive to the enabling signal for discontinuously opening the compartments of the container and including means having a contact surface and mounted for movement along the container to sequentially open each compartment, and a blocking surface positioned to engage the contact surface to halt the continued movement of the compartment opening means immediately subsequent to the opening of a particular compartment, the blocking surface being dimensioned to enable bypassing of the contact surface as the container supporting means moves the container towards said initial position in response to its decreasing weight.

2. The mixing system of claim 1 wherein the container-supporting means includes a frame-like member mounted for tilting about an axis of rotation, and including bias means for exerting a rotational force on the frame member in opposition to the weight of the container,

3. The system of claim 2 wherein the compartment opening means includes a plurality of cutting edges positioned for piercing contact with the container, and means for moving the cutting edges generally parallel to at least one surface of the container to destructively open a compartment wall.

4. The mixing system of claim 3 wherein the compartment-opening means includes conduit means oriented with respect to the cutting edge to introduce a quantity of flushing liquid into the exposed compartment interior during or immediately subsequent to the release of the contents thereof.

5. The mixing system of claim 1 wherein the liquid level sensing means including a shaft member extending generally upwardly from the lower portion of the reservoir, a float mounted about the shaft for free movement therealong in response to the liquid level in the reservoir, magnetically-responsive switch means associated with the shaft, a magnetically-responsive surface member affixed to the float with a selected one of the surface member and switch means being magnetic, and with the device affixed to the shaft being at a preselected height above the reservoir floor, and circuit means responsive to a state change the switch means to produce an enabling signal.

6. The mixing system of claim 5 wherein the magnetically-responsive switching means are mounted within the shaft so as to be isolated from fluid in the reservoir, and a magnetic surface is affixed to the float.

7. The mixing system of claim 6 wherein the switching means includes a plurality of magnetically responsive switches vertically disposed along the shaft so as to undergo respective state changes at different fluid levels.

8. The system of claim 1 including a magnetically responsive member positioned in the reservoir for contact with the solution therein and having a specific gravity which bears a predetermined relationship with the desired specific gravity of the solution;

magnetically responsive switch means, at least one of the switch means and member being magnetic; and means permitting constrained vertical movement of the member in the region of the switch means so that the switch means experiences state changes in response to the floating and sinking of the member; and liquid ingress control means responsive to the state changes to mix the amount of ingressing liquid with the compartmented contents which yields a desired specific gravity.

9. An automatic chemical mixing system comprising;

a housing including means defining a reservoir and means for supporting a container above the reservoir;

inlet and outlet conduit means communicating with the reservoir for respectively permitting the ingress and egress of liquids;

liquid level sensing means for producing an enabling signal when the liquid level of the reservoir falls below a preselected level;

means responsive to the enabling signal for permitting a predetermined quantity of base liquid to flow into the reservoir through the inlet conduit means;

a disposable multi-compartmented container supported by the supporting means; and means responsive to the enabling signal for slitting compartments at a pair of laterally spaced regions to destructively open the compartments of the container and permit egress of the contents, including a pair of cutting edges shaped for initially piercing contact with the container at said regions, each cutting edge being formed by the edge of a blade member having at least one through-hole to enhance the drainage of the compartment.

10. An automatic chemical mixing system comprising;

a housing including means defining a reservoir and means for supporting a container above the reservoir;

inlet and outlet conduit means communicating with the reservoir for respectively permitting the ingress and egress of liquids;

liquid level sensing means for producing an enabling signal when the liquid level of the reservoir falls below a preselected level;

means responsive to the enabling signal for permitting a predetermined quantity of base liquid to flow into the reservoir through the inlet conduit means;

a disposable multi-compartmented container supported by the supporting means; and means responsive to the enabling signal for slitting compartments at a pair of laterally spaced regions to destructively open the compartments of the container and permit egress of the contents, including a pair of cutting edges shaped for piercing contact with the container at said regions, and including conduit means oriented with respect to the cutting edge to introduce a quantity of flushing liquid into the exposed compartment interior during or immediately subsequent to the release of the contents thereof.

11. The mixing system of claim 10 wherein the flushing conduit means includes a nozzle mounted for movement with the blade and oriented for communication with the compartment interior through the through-hole.

12. An automatic chemical mixing system comprising;

a housing including means defining a reservoir and means for supporting a container above the reservoir;

inlet and outlet conduit means communicating with the reservoir for respectively permitting the ingress and egress of liquids;

liquid level sensing means for producing an enabling signal when the liquid level of the reservoir falls below a preselected level;

means responsive to the enabling signal for permitting a predetermined quantity of base liquid to flow into the reservoir through the inlet conduit means;

a disposable multi-compartmented container supported by the supporting means; and means responsive to the enabling signal for slitting compartments at a pair of laterally spaced regions to destructively open the compartments of the container and permit egress of the container, the slitting means including, a member mounted for movement adjacent the container in a direction generally transverse to the protrusions;

a pair of blade members obliquely-oriented with respect to each other to define a pair of laterally spaced cutting edges and mounted on the moveable member for slitting contact with the container along a pair of generally wedge-defining paths;

a container-deflecting member mounted on the moveable member for deflecting the portion of the container which lies interjacent the slits so that the deflected portion is wedged within the conswquential opening.

13. An automatic chemical mixing system comprising;

a housing including means defining a reservoir and means for supporting a container;

inlet and outlet conduit means communicating with the reservoir for respectively permitting the ingress and egress of liquid;

liquid level sensing means including a shaft member extending generally upwardly from the lower portion of the reservoir, a float mounted about the shaft for free movement therealong in response to the liquid level in the reservoir, magnetically-responsive switch means affixed to a selected one of the float and shaft, a magnetically-responsive surface member affixed to the other of the float and shaft, with a selected one of the surface member and switch means being magnetic and with the device affixed to the shaft being at a preselected height above the reservoir floor, and circuit means responsive to a state change the switch means to produce an enabling signal;

means responsive to the enabling signal for permitting a predetermined quantity of base liquid to plow into the reservoir through the inlet conduit means; and means responsive to the enabling signal for opening the compartments of the container.

14. The mixing system of claim 13 wherein the magnetically-responsive switching means are mounted within the shaft so as to be isolated from fluid in the reservoir, and a magnetic surface is affixed to the float.

15. The mixing system of claim 14 wherein the switching means includes a plurality of magnetically responsive switches vertically disposed along the shaft so as to undergo respective state changes different fluid levels.

16. For use in an automatic chemical mixing system of the type including a reservoir, means for supporting a multi-compartmented container, and means for opening the compartments to permit release of their contents into the reservoir, a multi-compartmented module comprising a plurality of mating, compartment-defining containers having respective face-engaging faces which are uniquely complimentary so as to restrict their interchangability within the module cluster; and means for securing the containers in their mating relationship to permit movement of the module as a unit.

17. The module of claim 16 wherein the module includes a first container having a first face adapted to function as a portion of the module base during use, the first face having a generally lip-shaped protrusion forming a complimentary recess in the compartment wall and positioned for opening contact by the compartment-opening means.

18. The module of claim 17 wherein one of the module faces extending from the base face is generally concave.

19. The module of claim 17 adapted for use in a mixing system having a pair of laterally displaced container-opening members movable from a neutral position to a container-opening position along a path adjacent the module base, wherein the first face additionally includes a recessed portion interjacent the lip-shaped protrusion and an unrecessed base portion for overlying the neutrally-positioned container-opening members when the module is in its supported position, the lip-shaped protrusion thereby extending downward in the path of the container-opening members, and a channel-defining protrusion extending from the unrecessed base portion to the lip-shaped protrusion to define a channel in the corresponding compartment wall having a level approximately no higher than the wall defined by unrecessed base portion.

20. The module of claim 19 wherein the channel-defining protrusion is generally centrally located in the first face to lie between the neutrally positioned compartment-opening members.

21. The module of claim 16 adapted for use in a mixing system having a pair of laterally displaced container-opening members longitudinally movable from a neutral position to successive container-opening positions along a path adjacent the module base, and including a first compartment-defining container having a generally laterally extending, lip-shaped protrusion in the face forming a portion of the module base during use, second and third laterally disposed compartment-defining containers engaging a second face of the first container, the second face being generally upward extending from the module base during use, at least a portion of the second and third container bases extending downward to the level of the lip-shaped protrusion, whereby the second and third compartments are serially opened with the first compartment by respective ones of the laterally displaced container-opening members.

22. The module of claim 16 wherein one of the containers includes an integrally formed handle.

23. An automatic chemical mixing system comprising;

a housing including means defining a reservoir and means for supporting a container;

inlet and outlet conduit means communicating with the reservoir for respectively permitting the ingress of base liquid and egress of mixed solution;

a member in communication with the solution in the reservoir and having a specific gravity bearing a pre-determined relationship with the desired specific gravity of the solution;

means selectively responsive to the rising and falling of the member to produce an actuating signal when the solution density is substantially at the desired value; and means responsive to the actuating signal to discontinue the ingress of the base liquid.

24. The system of claim 23 including magnetically responsive switch means isolated from contact with the solution, and wherein the member in communication with the solution contains magnetically responsive material, at least one of the member material and switch means being magnetic so that the switch means undergoes a state transition in response to the rising and falling of the member.

25. The system of claim 24 including a generally vertical tubular shaft enclosing at least a portion of the switch means and wherein the member is mounted for vertical movement along the shaft.

26. The mixing system of claim 1 wherein the compartment-opening means includes a cutting edge mounted for piercing movement with respect to the container to sequentially release the contents of the compartments.

27. The mixing system of claim 26 wherein the cutting edge is formed by the edge of a generally planar member formed with at least one through-hole to enhance the drainage of the compartment.

28. The mixing system of claim 26 wherein the compartment-opening means includes conduit means oriented with respect to the cutting edge to introduce a quantity of flushing liquid into the exposed compartment interior during or immediately subsequent to the release of the contents thereof.

29. The mixing system of claim 28 wherein the flushing conduit means includes a nozzle mounted for movement with the blade and oriented for communication with the compartment interior through the pierced compartment wall.

30. The mixing system of claim 1 further including a disposable multi-compartmented container whose exterior surface adjacent the knife blade includes a plurality of lip-shaped protrusions respectively defining a portion of a compartment wall.

31. The mixing system of claim 30 wherein the compartment-opening means includes a member mounted for movement adjacent the container in a direction generally transverse to the protrusions;

a pair of laterally spaced cutting edges mounted on the moveable member for slitting contact with the protrusions;

a protrusion-deflecting member mounted on the moveable member for deflecting the portion of the protrusion which lies interjacent the slits.

* * * * *